United States Patent [19]

Inoue et al.

[11] Patent Number: 5,017,463

[45] Date of Patent: May 21, 1991

[54] DEVELOPMENT PROCESSING METHOD FOR SILVER HALIDE PHOTOGRAPHIC MATERIALS

[75] Inventors: Nobuaki Inoue; Katsumi Hayashi, both of Kanagawa, Japan

[73] Assignee: Fuji Photo Film Co., Ltd., Kanagawa, Japan

[21] Appl. No.: 421,037

[22] Filed: Oct. 13, 1989

[30] Foreign Application Priority Data

Oct. 14, 1988 [JP] Japan ..... 63-258564

[51] Int. Cl.[5] ..... G03C 3/00

[52] U.S. Cl. ..... 430/398; 430/403; 430/428; 430/434; 430/621; 430/944; 430/963

[58] Field of Search ..... 430/398, 403, 428, 434, 430/621, 944, 963

[56] References Cited

U.S. PATENT DOCUMENTS 4,826,757 5/1989 Yamada et al. ..... 430/434

FOREIGN PATENT DOCUMENTS 0138543 4/1985 European Pat. Off. ..... 430/944

62-087952 4/1987 Japan ..... 430/539

*Primary Examiner*—Charles L. Bowers, Jr.

*Assistant Examiner*—Thomas R. Neville

*Attorney, Agent, or Firm*—Sughrue, Mion, Zinn Macpeak & Seas

[57] ABSTRACT

A process for developing a silver halide photographic material having, on a support, at least one silver halide emulsion layer comprising a silver halide emulsion spectrally sensitized by an infrared-sensitizing dye, which is subjected to image-wise exposure, then development and fixing processing and then washing or stabilization processing, wherein the silver halide in the silver halide emulsion layer contains 90 mol % or more of silver chloride, the swelling rate for hydrophilic colloid layers containing the silver halide emulsion layer is 150% or less, and the replenishment in the washing or stabilization processing is 1,200 ml or less per square meter of the photographic material.

11 Claims, No Drawings

DEVELOPMENT PROCESSING METHOD FOR SILVER HALIDE PHOTOGRAPHIC MATERIALS

FIELD OF THE INVENTION

This invention relates to a development processing method for silver halide photographic materials which have been spectrally sensitized in the infrared region. More specifically, it relates to photographic materials for plate making which have been spectrally sensitized in the infrared region and to a development processing method using these.

BACKGROUND OF THE INVENTION

As one method of exposing a photosensitive material, there is known the so-called scanner system image formation method in which an original is scanned and an exposure is made on a silver halide photographic material based on this image signal to form a negative image or a positive image corresponding to the image of the original.

There are various recording devices which make practical use of the scanner system image formation method and these scanner system recording devices have conventionally used glow lamps, xenon lamps, mercury lamps, tungsten lamps, light-emitting diodes and the like for their recording light source. However, all these light sources have practical disadvantages such as a weak output and a short life. By way of scanners which make up for these disadvantages, there are those which make use of a Ne-He laser, argon laser, He-Cd laser or other such coherent laser light source as the light source for the scanner system. With these, a high output is obtained, but there are disadvantages in that the device is large, expensive and requires a modulator, and the handling properties are inferior, there being restrictions on the safelight of the photosensitive material since visible light is used.

In contrast, semiconductor lasers have the advantages that they are small-scale, inexpensive and easy to modulate, have a longer life than the abovementioned lasers and have improved handling operability since, because they emit light in the inffared region, it is possible to use a bright safelight when a photosensitive material having a sensitivity in the infrared region is employed.

Recently, photosensitive materials which are compatible with semiconductor lasers making use of the above advantages have been put on the market.

The computerization of the printing industry, notably with the layout scanner, has made volume and high quality printing possible in the office as well due to reductions in size. Thus, there is a method involving outputting the whole of the plate preparation stage onto printing paper or film using a computer photosetting apparatus via a floppy disk, the operation being carried out on a CRT screen, employing a photographic material which is sensitive to a semiconductor laser (680 nm).

However, the abovementioned photosensitive materials have problems in that they require a large space for replenishing the solution or in their operational environment since large amounts of developing solution are used in the office, and there is therefore a desire for silver halide photographic materials and a development processing method with which there is little performance variation and with which the rollers in the dry zone of the automatic developing apparatus are not contaminated even when replenishment amounts are reduced and water-saving processing is carried out.

Photographic materials composed of silver halide grains which are sensitive to semiconductor laser light, i.e. which are spectrally sensitized to the infrared region, and which contain silver chloride are described in JP-A-60-80841, JP-A-62-299838, JP-A-62-299839, JP-A-61-70550, JP-A-63-115159, JP-A-63-115160 and JP-A-63115161 (the term "JP-A" as used herein means an "unexamined published Japanese Patent Application"). Silver bromide or silver iodobromide systems are described in JP-A-63-49752, JP-A-63-83719 and JP-A-63-89838.

In addition to the dyes described in the abovementioned patents, many sensitizing dyes have previously been disclosed for enhancing the speed in the infrared region. These are described, for example, in U.S. Pat. Nos. 2,095,854, 2,095,856, 2,955,939, 3,458,318, 3,482,978, 3,552,974, 3,573,921, 3,582,344, 3,615,632 and 4,011,083.

Methods for improving development unevenness or silver staining during development processing are described in JP-A-56-24347, JP-A-62-212615, JP-A-57-26848, JP-A-57-116340, JP-A-60-258537 and JP-A-62-212651.

SUMMARY OF THE INVENTION

The first objective of this invention is to provide silver halide photographic materials having sensitivity in the infrared region and with little performance variation even when the film is processed simply and rapidly.

The second objective of this invention is to provide a development processing method with which silver halide photographic materials having sensitivity in the infrared region can be developed by a process with which water economy is possible in the washing process to provide a photographic image of outstanding quality with a finish without staining or processing unevenness.

The abovementioned objectives of this invention have been achieved by means of a development processing method for silver halide photographic materials having, on a support, at least one silver halide emulsion layer comprising a silver halide emulsion spectrally sensitized by an infrared-sensitizing dye, which are subjected to image-wise exposure, then development and fixing processing and then washing or stabilization processing, wherein the silver halide in the silver halide emulsion layer contains 90 mol% or more of silver chloride, the swelling rate for hydrophilic colloid layers containing the silver halide emulsion layer is 150% or less, and the replenishment amount in the washing or stabilization processing is 1,200 ml or less per square meter of the photographic material.

DETAILED DESCRIPTION OF THE INVENTION

The silver halide emulsions of the silver halide photographic materials used in this invention are silver choride, silver chlorobromide, silver chloroiodide or silver chloroiodobromide composed of 90 mol% or more and preferably 95 mol% or more of silver chloride, and the silver bromide content is 0–10 mol% and the silver iodide content 0–2 mol%.

The form of the silver halide grains in accordance with this invention may, for example, be cubic, octahedral, tetradecahedral, tabular or spherical, but cubic and tetradecahedral are preferred.

The silver halide emulsions in this invention are preferably monodisperse silver halide emulsions with a variation coefficient of 20% or less and particularly preferably 15% or less.

The variation coefficient as referred to herein is defined as $$\text{Variation coefficient (\%)} = \frac{\text{Standard deviation in grain size}}{\text{Average grain size}} \times 100$$

The grain size is preferably 0.06μ–0.6 μ and particularly preferably 0.06 μ–0.4 μ.

The photographic emulsions which can be used in this invention can be prepared using a method described, for example, in *Chimie et Physique Photographique* by P. Glafkides (Paul Montel Co. 1967), *Photographic Emulsion Chemistry* by G.F. Duffin (The Focal Press, 1966) and *Making and Coating Photographic Emulsions* by V.L. Zelikman et al. (The Focal Press, 1964).

Thus, any of the acidic method, netural method, ammonia method or the like may be used, and any of the single jet method, double jet method or a combination thereof may be used as the method for formation by reacting the soluble silver salts and soluble halogen salts. It is possible to use the method in which the grains are formed in an excess of silver ions (the so-called reverse mixing method).

As one form of the double jet method, it is possible to use the method in which the pAg in the silver-halide-forming liquid phase is kept constant, which is to say the controlled double jet method. Silver halide emulsions in which the crystal form is regular and the grain size is close to uniform are obtained with this method.

Further, in order to render the grain size uniform, it is preferable to effect rapid growth in a region in which critical saturation is not exceeded using a method in which the silver nitrate and alkali halide addition rate is varied in accordance with the grain formation rate as described in G.B. Patent 1,535,016, JP-B-48-36890 and JP-B-52-16364 (the term "JP-B" as used herein means an "examined Japanese patent publication") or the method in which the aqueous solution concentration is varied as described in G.B. Patent 4,242,445 and JP-A-55-158124.

When preparing a silver chloride monodisperse emulsion in this invention, good results can be obtained if it is prepared at a silver potential of 100 mV or more and preferably 150 mV–400 mV under conditions of an adequately high stirring rate so as to mix uniformly. In the case of silver chloride grains, there will be cases in which grain growth occurs in both the washing stage and dispersion stage due to their high solubility, and it is possible to adopt a temperature of 35° C. or less or to jointly provide a nucleic acid, mercapto compound, tetraazaindene compound or the like which inhibits grain growth.

With the silver halide emulsions of this invention, it is preferable to add a rhodium salt or an iridium salt in a preparation stage prior to the completion of physical ripening, particularly during the grain formation.

By way of rhodium salts, it is possible to mention rhodium monochloride, rhodium dichloride, rhodium trichloride, ammonium hexachlororhodate or the like, but water-soluble trivalent halogen complex compounds of rhodium such as hexachlororhodium (III) acid or salts thereof (for example, the ammonium salt, sodium salt or potassium salt) are preferred.

Iridium salts include water-soluble iridium salts or iridium complex salts, for example, iridium trichloride, iridium tetrachloride, potassium hexachloroiridate (III), potassium hexachloroiridate (IV) and ammonium hexachloroiridate (III). The preferred range for the rhodium salts and iridium salts is $1\times10^{-8}$ to $1\times10^{-6}$ mole/mole Ag, respectively.

High silver chloride grains which are used for preference in this invention are the silver halide grains in which cubic grains with a silver chloride content of 90 mol% have a high silver bromide region in the vicinity of their apex as described in U.S. patent application Ser. No. 07/286,775 filed Nov. 20, 1988.

The silver halide emulsions used in the method of this invention need not be chemically sensitized, but they may be chemically sensitized. Sulfur sensitization, reduction sensitization and noble metal sensitization are known as chemical sensitization methods for silver halide emulsions, and chemical sensitization may be carried out using any of these either singly or in conjunction.

By way of gold sensitizers used in this invention, there are various gold salts including, for example, potassium chloroauride, potassium auric thiocyanate, potassium chloroaurate and auric trichloride.

By way of sulfur sensitizers used in this invention, it is possible to use various sulfur compounds such as thiosulfates, thioureas, thiazoles, rhodanines and the like in addition to the sulfur compounds contained in gelatin.

The preferred amounts of sulfur sensitizers and gold sensitizers added are $10^{-2}-10^{-7}$ mole and preferably $1\times10^{-3}-1\times10^{-5}$ mole per mole of silver.

On a molar basis, the ratio between sulfur sensitizers and gold sensitizers is 1:3–3:1 and preferably 1:2–2:1.

In this invention, there is no impediment to the inclusion of a noble metal other than a gold sensitizer such as a complex salt of platinum, palladium or iridium.

In this invention it is possible to use a reduction sensitization method.

It is possible to use a stannous salt, amine, formamidinesulfinic acid, silane compound or the like as the reduction sensitizer.

The swelling rate in hydrophilic colloid layers of the silver halide photographic material of this invention is 150% or less and preferably 80%–130%.

If the swelling rate exceeds 150%, the carry-over of developing and fixing solutions into the washing stage is increased which causes staining or degredation. Further, drying imperfections or transit imperfections are liable to occur during rapid processing in an automatic developing apparatus, but if the amount of hardeners in the fixing solution is increased in order to remedy this the hardeners will precipitate and stain the photographic material.

Conversely, if the swelling rate is lowered, there will be problems such as a slow development progress, fixing imperfections or residual color from the sensitizing dyes, but this can be adequately compensated for by a rapid fixing rate or the development properties of the high silver chloride emulsion.

The swelling rate of the hydrophilic colloid layers of this invention is determined in the stages (a), (b) and (c) given below.

(a) The thickness of the hydrophilic colloid layer in the abovementioned silver halide photographic material is measured. (b) The said silver halide photographic material is immersed in distilled water at 25° C. for one minute. (c) The percentage change in the thickness of the layer is measured by comparison with the thickness of the layer measured in stage (a).

Thus, the proportional swelling of the hydrophilic colloid layer in this invention is expressed as a percentage of the swelling of the total film thickness of all the hydrophilic colloid layers (for example, silver halide emulsion layers, surface protective layer, intermediate layers) present on the side of the silver halide emulsion layers on the support after immersion in distilled water at 25° C. for one minute.

The non-photosensitive hydrophilic colloids and the photographic emulsions of this invention can contain inorganic or organic gelatin hardeners. For example, it is possible to use, either singly or in combination, active vinyl compounds (for example, 1,3,5-triacryloylhexahydro-s-triazine, bis(vinylsulfonyl) methyl ether, N,N'-methylenebis-[β-(vinylsulfonyl)propionamide]), active halogen compounds (for example, 2,4-dichloro-6-hydroxy-s-triazine), mucohalogen acids (for example, mucochloric acid), N-carbamoylpyridinium salts (for example, (1-morpholinocarbonyl-3-pyridinio)methanesulfonate), and haloamidinium salts (for example, 1-(1-chloro-1-pyridinomethylene)pyrolidinium, 2-napthalene sulfonate). Of these, the active vinyl compounds described in JP-A-53-41220, JP-A-53-57257, JP-A-59-162546 and JP-A-60-80846, and the active halogen compounds described in U.S. Pat. No. 3,325,287 are preferred.

Several examples of specific gelatin hardening compounds are now given. However, the invention is not limited to the following compounds.

$CH_2{=}CHSO_2CH_2SO_2CH{=}CH_2$ I-(1)

$CH_2{=}CHSO_2(CH_2)_2SO_2CH{=}CH_2$ I-(2)

$CH_2{=}CHSO_2CH_2OCH_2SO_2CH_2CH_2$ I-(3)

$CH_2{=}SO_2CH_2\overset{OH}{\overset{|}{C}}HCH_2SO_2CH{=}CH_2$ I-(4)

-continued $CH_2{=}CHSO_2CH_2CONH$ I-(5)

$(CH_2)_2$ $CH_2{=}CHSO_2CH_2CONH$

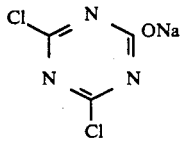
I-(6)

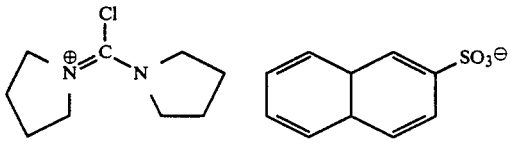
I-(7)

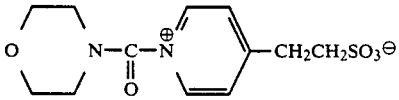
I-(8)

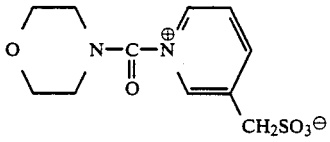
I-(9)

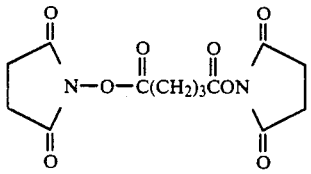
I-(10)

For the infrared spectrally sensitizing dyes used in this invention, the dyes described in JP-A-60-80841, JP-A-62-299838 and JP-A-62-299839 are preferred and specific examples are given below. Hereafter these dyes are referred to as infrared sensitizing dyes.

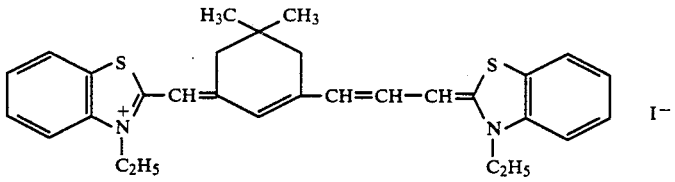
II-1

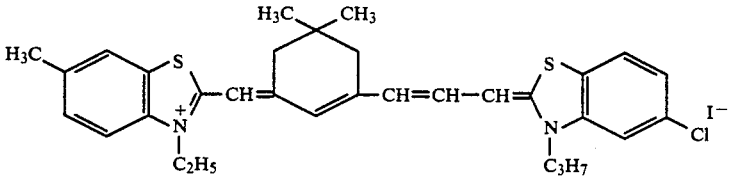
II-2

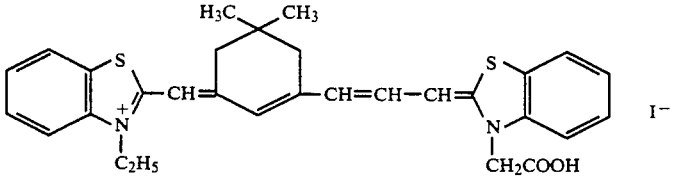
II-3

-continued
II-4
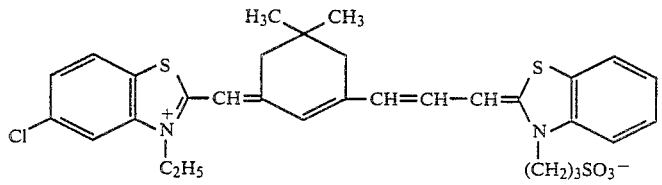
II-5
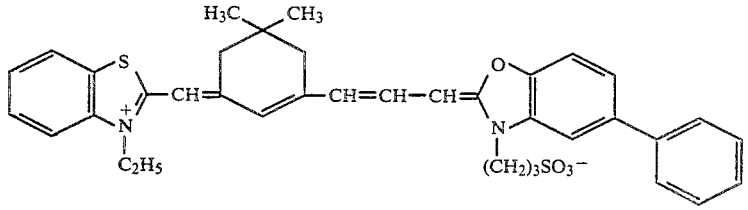
II-6
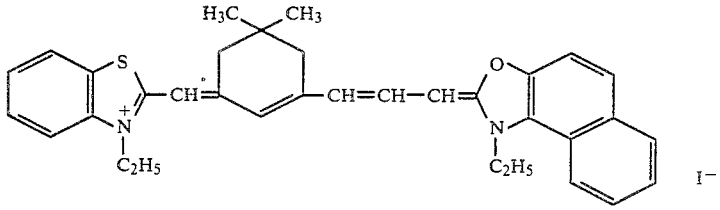
II-7
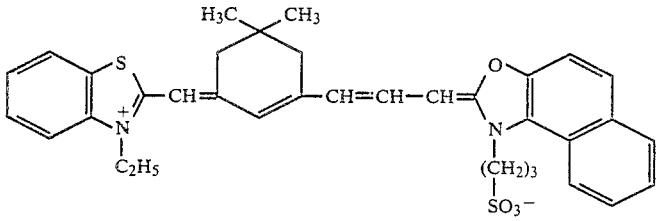
II-8
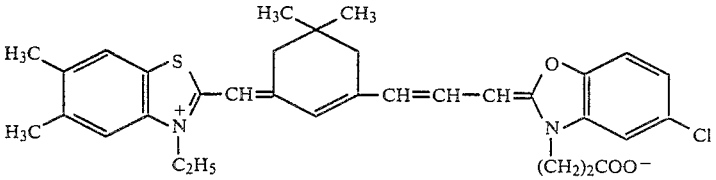
II-9
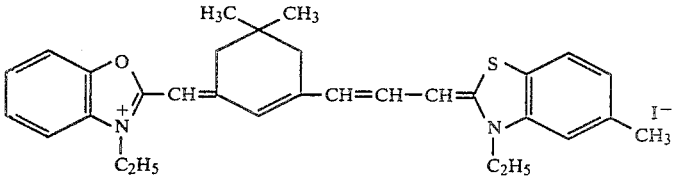
II-10
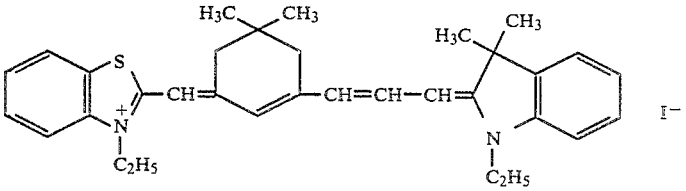
II-11
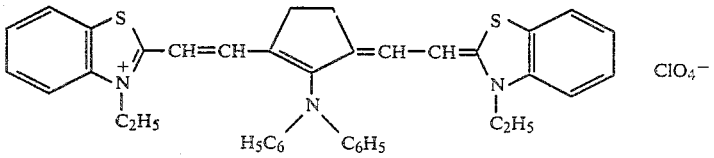

-continued
II-12
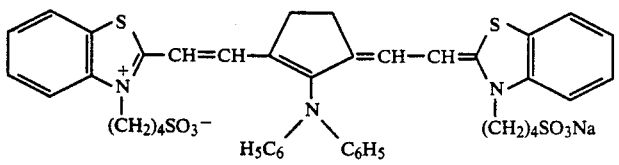
II-13
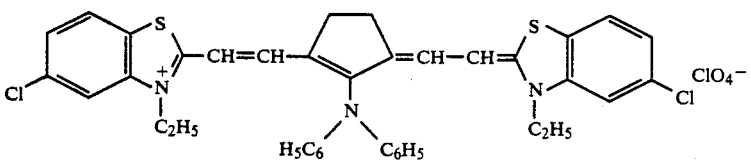
II-14
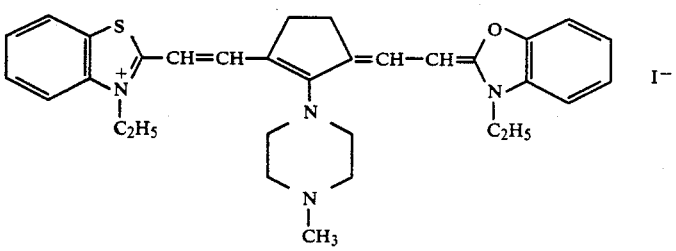
II-15
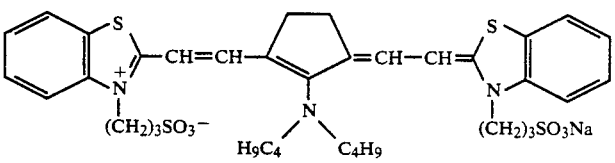
II-16
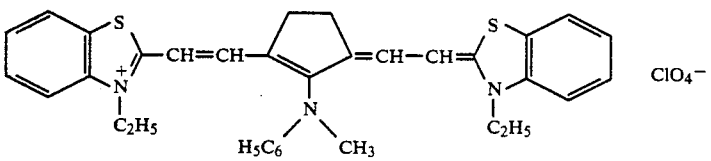
II-17
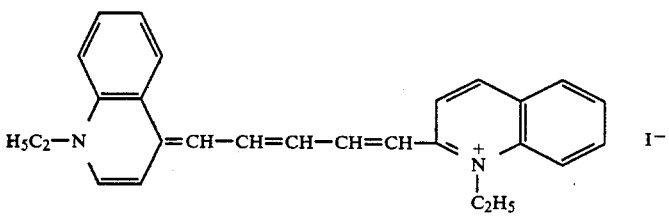
II-18
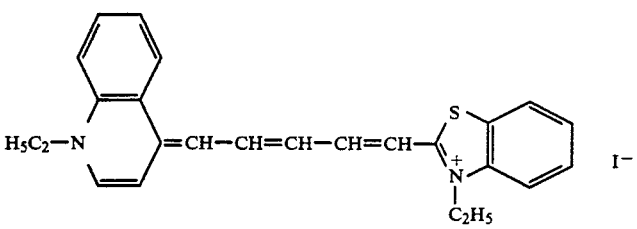
II-19
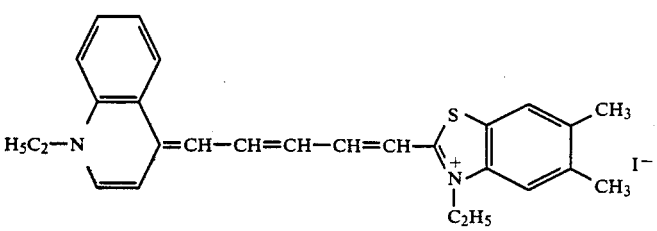

-continued

II-20

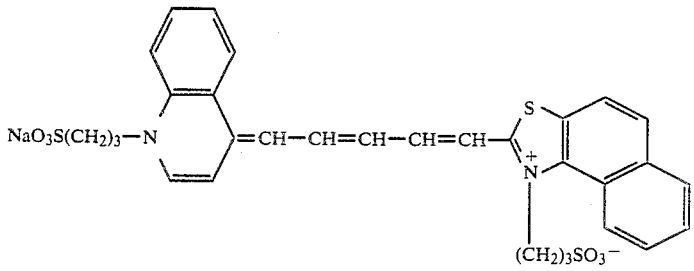

II-21

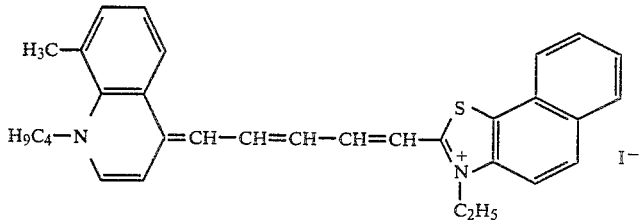

II-22

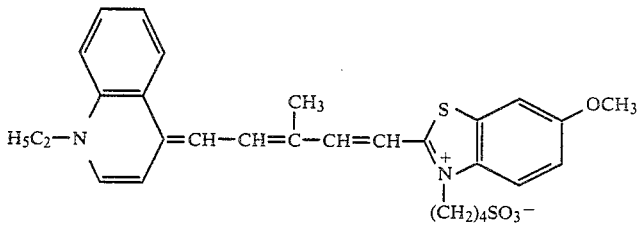

II-23

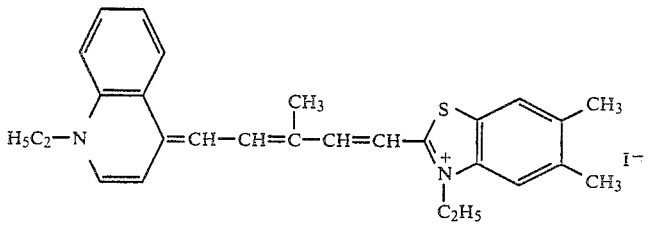

II-24

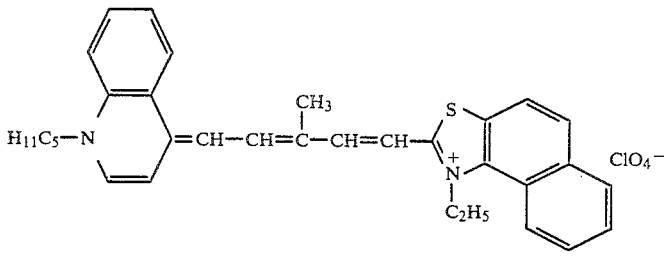

The abovementioned infrared sensitizing dyes used in this invention are contained in the silver halide photographic emulsion in a proportion of $5\times10^{-7}$ mole to $5\times10^{-3}$ mole, preferably $1\times10^{-6}$ mole to $1\times10^{-3}$ mole, and particularly preferably $2\times10^{-6}$ mole to $5\times10^{-4}$ mole per mole of silver halide.

The abovementioned infrared sensitizing dyes used in this invention can be dispersed directly in the emulsion. Alternatively, they can be added to the emulsion in the form of a solution being first dissolved in a suitable solvent such as methyl alcohol, ethyl alcohol, methyl cellosolve, acetone, water, pyridine or a mixed solvent thereof. Further, it is possible to use ultrasonic waves when dissolving. Further, as the addition method for the abovementioned infrared sensitizing dyes, there are used: the method in which the dye is dissolved in a volatile organic solvent, the solution is dispersed in the hydrophilic colloid and this dispersion is added to the emulsion as described in U.S. Pat. No. 3,469,987; the method in which a water-insoluble dye is dispersed in a water-soluble solvent without being dissolved and this dispersion is added to the emulsion as described, for example, in JP-B-46-24185; the method in which the dye is dissolved in a surfactant and the solution is added to the emulsion as described in U.S. Pat. No. 3,822,135; the method in which the dissolution is carried using a red-shifting compound and the said solution is added to the emulsion as described in JP-A-51-74624; and the method in which the dye is dissolved in an acid essentially containing no water and the said solution is added to the emulsion as described in JP-A-50-80826. Apart from these, the methods described, for example in U.S. Pat. Nos. 2,912,343, 3,342,605, 2,996,287 and 3,429,835 are used for the addition to the emulsion. Further, the abovementioned infrared sensitizing dyes may be uniformly dispersed in the silver halide emulsion prior to coating onto an appropriate support, and they can obviously be dispersed in any stage during the preparation of the silver halide emulsion.

Other additional sensitizing dyes may be used in combination with the sensitizing dyes according to this invention. For example, it is possible to use the sensitizing dyes described, for example, in U.S. Pat. Nos. 3,703,377, 2,688,545, 3,397,060, 3,615,635, 3,628,964, G.B. Patents 1,242,588, 1,293,862, JP-B-43-4936, JP-B-44-14030, JP-B-43-10773, U.S. Pat. No. 3,416,927, JP-B-43-4930, U.S. Pat. Nos. 3,615,613, 3,615,632, 3,617,295 and 25 3,635,721.

In order to improve the infrared spectral sensitization effect or to improve storage properties, it is preferable to add the compounds of general formulae (III) and (IV) of JP-A-60-80841 to the photographic materials of this invention. Specific compound examples are given below, and hereafter, referred to as compound (III).

III-1

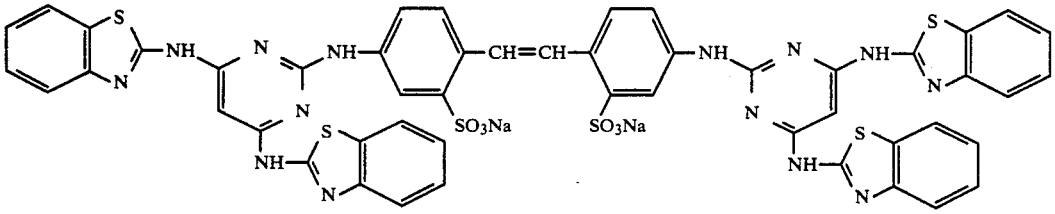

III-2

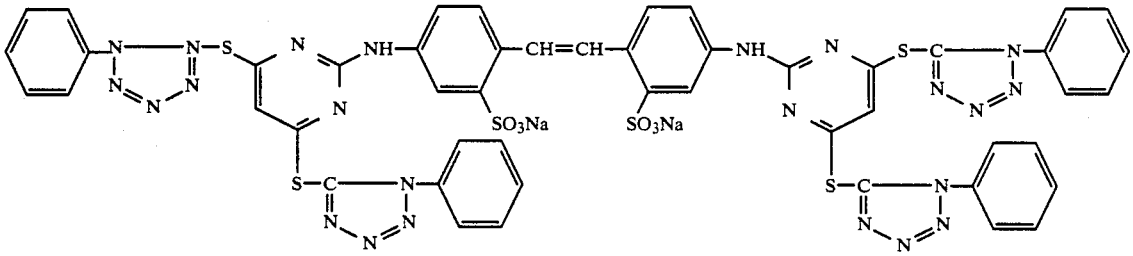

III-3

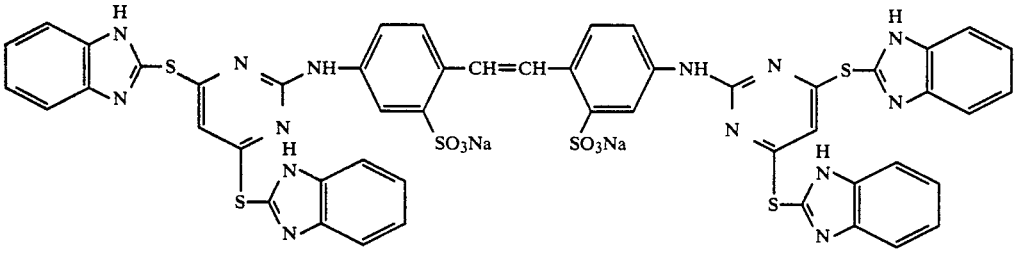

III-4

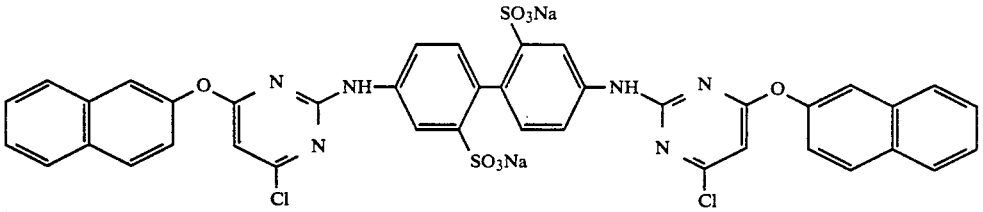

III-5

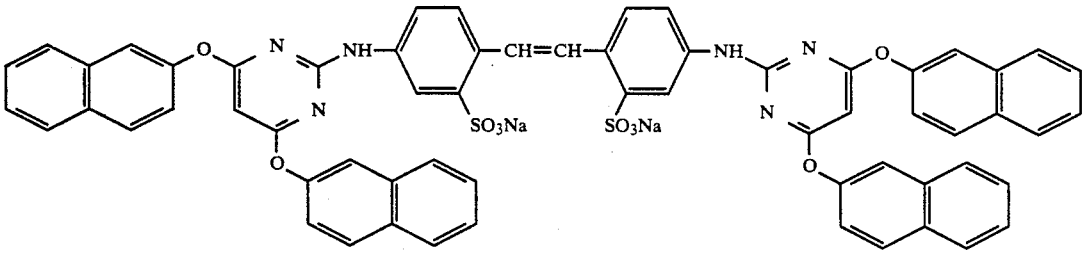

III-6

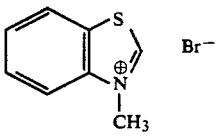

-continued

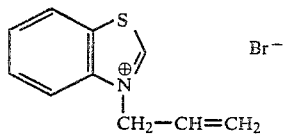

III-7

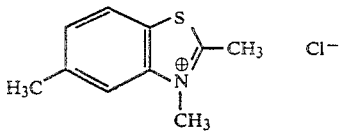

III-8

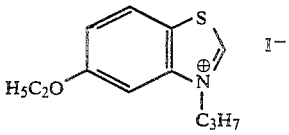

III-9

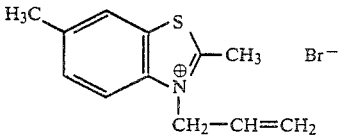

III-10

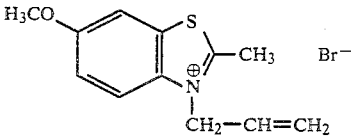

III-11

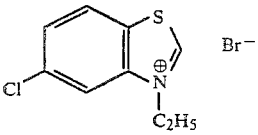

III-12

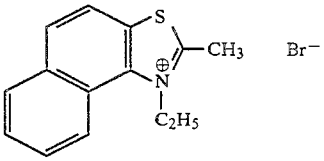

III-13

The abovementioned compounds III are advantageously used in an amount of about 0.01 gram to 5 grams per mole of silver halide in the emulsion.

As regards the ratio (weight ratio) of the abovementioned infrared sensitizing dye II and compound III of this invention, it is beneficial to use a range of 1/1-1/300 and particularly advantageous to use a range of 1/2-1/50 of the infrared sensitizing dye of this invention to the compound represented by a compound (III).

Compound (III) when used in this invention can be directly dispersed in the emulsion or it can be added to the emulsion by dissolving in a suitable solvent (such as water, methyl alcohol, ethyl alcohol, propanol, methyl cellosolve or acetone) or a mixed solvent using a plurality of these solvents. Additionally, it can be added to the emulsion in the form of a dispersion in a colloid or solution following an addition method for the sensitizing dye.

Compound (III) of this invention may be added to the emulsion either before or after the addition of the abovementioned infrared sensitizing-dye of this invention. Further, compound (III) and the infrared sensitizing dye may be dissolved separately and these may be added separately and simultaneously to the emulsion or they may be mixed and then added to the emulsion.

It is preferable that the photographic material of this invention contains a polyhydroxybenzene compound, and it is preferable that this is a compound having any of these structures given below.

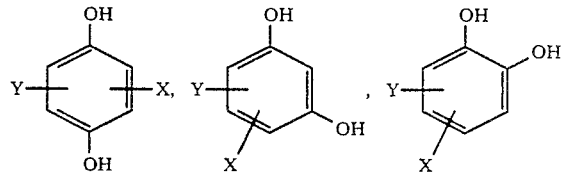

X and Y are respectively —H, —OH, halogen atoms, —OM (where M is an alkali-metal ion), alkyl group, phenyl group, amino group, carbonyl group, sulfo group, sulfonated phenyl group, sulfonated alkyl group, sulfonated amino group, sulfonated carbonyl group, carboxyphenyl group, carboxyalkyl group, carboxyamino group, hydroxyphenyl group, hydroxyalkyl group, alkylether group, alkylphenyl group, alkylthioether group or phenylthioether group.

More preferably, it is —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$,

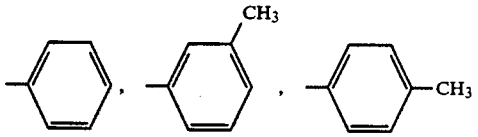

or the like. X and Y may be identical or different.

Examples of particularly preferred representative compounds are

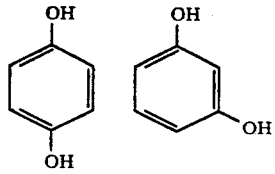

IV-1

IV-2

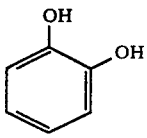

IV-3

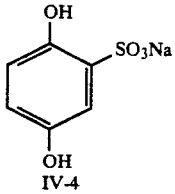

IV-4

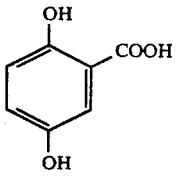

IV-5

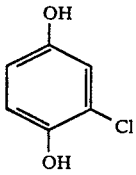

IV-6

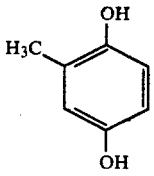

IV-7

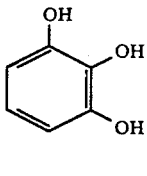

IV-8

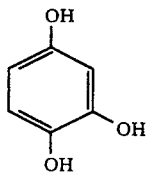

IV-9

-continued

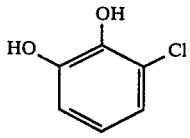

IV-10

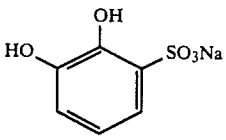

IV-11

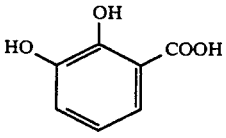

IV-12

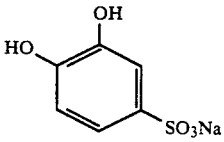

IV-13

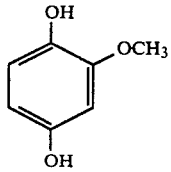

IV-14

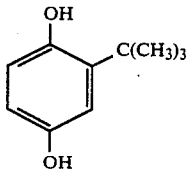

IV-15

The substituent groups X, Y and compounds of this invention are not limited by the above.

The polyhydroxybenzene compounds of this invention may be added to an emulsion layer in the photosensitive material or they may be added to layers other than the emulsion layers. An added amount in the range of $10^{-5}$-1 mole per mole of silver is effective and a range of $10^{-3}$ mole-$10^{-1}$ mole is particularly effective.

In particular, hydroquinone derivatives are extremely effective in silver chloride emulsions not only improving the processability as developing agent components but also having an effect on the pressure properties or in preventing thermofogging and the like.

In order to improve the image quality in the photographic materials of this invention, it is preferable to add an antihalation dye or an antiirradiation dye. Preferred dyes are the photographic dyes represented by general formulae (Va) to (Vd) described in JP-A-60-80841. Preferred representative specific examples are given below.

V-1

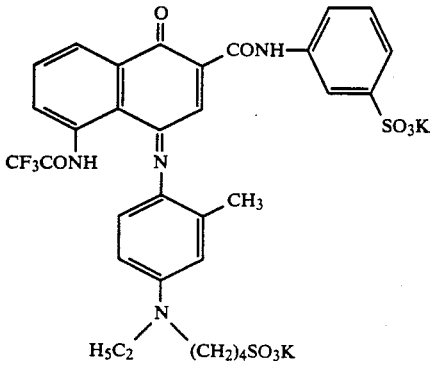

-continued

V-2

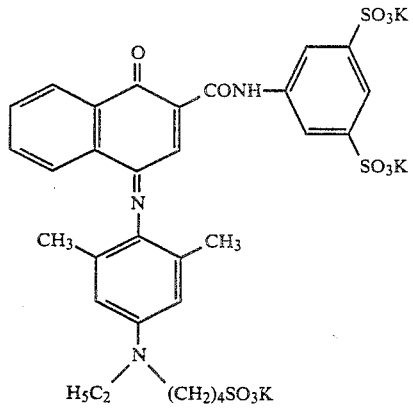

V-3

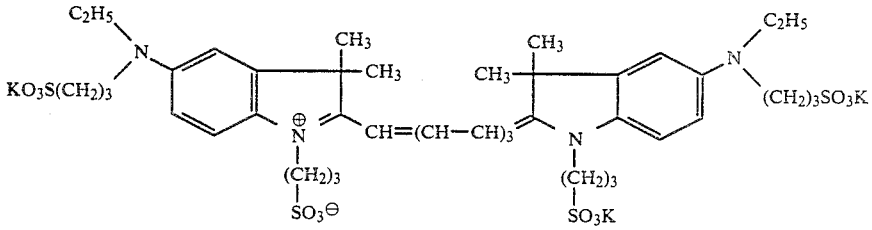

V-4

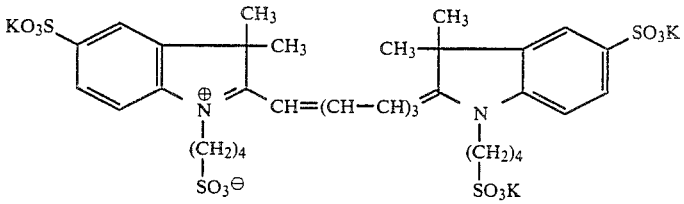

V-5

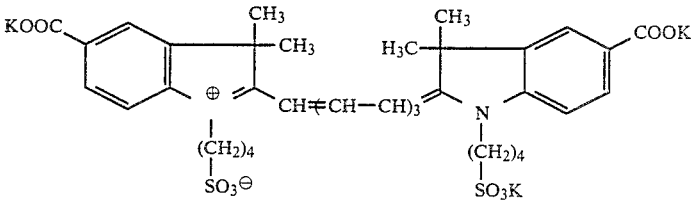

V-6

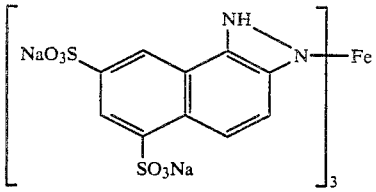

As specific examples of dyes represented by general formulae (Va) to (Vc) mentioned above, in addition to the substances given above, it is also possible to use those described in JP-A-62-3250, JP-A-61-174540, JP-A-62-123454 and Japanese Patent Application No. 60-174940. These dyes may be used individually or two or more may be used in conjunction.

These photographic dyes are particularly effective for antiiradiation and they are chiefly incorporated into the emulsion layers for the purpose.

Further, they are also effective for antihalation, and in the case they are provided on the back surface of the support or in a layer between the support and the emulsion layers.

The photographic dyes may be used to impart workability under safelight to the photographic material. For the purpose, they are incorporated into a layer located above the emulsion layers, such as a protective layer, in combination with dyes which absorb different wavelength light if desired. Moreover, the photographic dyes may also be used as filter dyes.

The photographic dyes can be introduced in a desired layer depending on the purpose as described above in a conventional manner. That is, the dye is dissolved in a solvent at a proper concentration and then added to an aqueous solution of hydrophilic colloid which is a binder of the layers constituting the photographic material, followed by coating on the support or on the other constituting layers.

These dyes can be added in any layer of hydrophilic colloid layers of the photographic material, such as a protective layer, a silver halide emulsion layer, an antihalation layer, a backing layer and the like.

In case where these dyes are incorporated into a backing layer, they are used in an amount sufficient to produce a transmitted optical density at 740–840 nm in the backing layer of 0.6 or greater.

The actual amount used will vary depending on the type of dye and the purposes of the dye, but it is generally possible to produce preferred effects in the region $10^{-3}$ g/m$^2$–1 g/m$^2$, in particular $10^{-3}$ g/m$^2$–0.5 g/m$^2$.

The photographic materials of this invention can contain various compounds in order to prevent fogging of the photographic material during the preparation stage, storage or photographic processing or to stabilize the photographic properties. Thus, it is possible to add many known compounds as antifoggants or stabilizers, for example azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione; azaindenes such as triazaindenes; tetraazaindenes (in particular, 4-hydroxy-substituted (1,3,3a,7) tetraazaindenes), pentaazaindenes and the like; benzenethiosulfonic acid, benzenesulfinic acid, benzenesulfonic acid amides and the like.

The photographic materials of this invention may also contain water-soluble dyes as filter dyes in the hydrophilic colloid layer or for irradiation prevention or various other purposes. Such dyes include oxonol dyes, hemioxonol dyes, styryl dyes, merocyanine dyes, cyanine dyes and azo dyes. Of these, oxonol dyes, hemioxonol dyes and merocyanine dyes are effective.

For purposes of speed enhancement, contrast enhancement or development acceleration, the photographic emulsion layers of the photographic materials of this invention may contain developing agents such as polyalkylene oxides or derivatives thereof such as ethers, esters and amines, thioether compounds, thiomorpholines, a quaternary ammonium salt compound, urethane derivatives, urea derivatives, imidazole derivatives, 3-pyrazolidones and aminophenols. Of these, 3-pyrazolidones (for example, 1-phenyl-3-pyrazolidone, 1-phenyl-4-methyl-4-hydroxymeth-yl-3-pyrazolidone) are preferred and these are normally used at 5 g/m$^2$ or less, preferably 0.01–0.2 g/m$^2$.

The photographic emulsions and non-photosensitive hydrophilic colloids of this invention may contain inorganic or organic film hardeners. For example, it is possible to use, either singly or in combination, active vinyl compounds (for example, 1,3,5-triacryloylhexahydro-s-triazine, bis(vinylsulfonyl) methyl ether, N,N-methylenebis[$\beta$-(vinylsulfonyl)propionamide]), active halogen compounds (for example, 2,4-dichloro-6-hydroxy-s-triazine), mucohalic acids, (for example, mucochloric acid), N-carbamoylpyridinium salts (for example, (1-morpholinocarbonyl-3-pyridinio)methanesulfonate), haloamidinium salts (1-(1-chloro-1-pyridinomethylene)pyrrolidinium, 2-napthalenesulfonate). Of these, the active vinyl compounds disclosed in JP-A-53-41220, JP-A-53-57257, JP-A-59-162546 and JP-A-60-80846 and the active halogen compounds described in U.S. Pat. No. 3,325,287 are preferred.

The photographic emulsion layers or other hydrophilic colloid layers of the photographic materials of this invention may contain auxiliary coating agents and various surfactants for various purposes such as static prevention, improving slip properties, emulsification and dispersion, preventing sticking and improving the photographic characteristics (for example, development acceleration, harder gradation and increased sensitivity).

For example, it is possible to use nonionic surfactants such as saponin (steroid-based), alkylene oxide derivatives (for example, polyethylene glycol, polyethylene glycol/polypropylene glycol condensates, polyethylene glycol alkyl ethers or polyethylene glycol alkyl aryl ethers, polyethylene glycol esters, polyethylene glycol sorbitane esters, polyalkylene glycol alkyl amines or amides, polyethylene oxide adducts of silicone), glycidol derivatives (for example, alkenylsuccinic acid polyglyceride, alkylphenol polyglyceride), fatty acid esters of polyhydric alcohols and alkyl esters of carbohydrates; anionic surfactants containing acidic groups such as the carboxyl group, sulfo group, phospho group, sulfuric acid ester group and phosphoric acid ester group, for instance, alkylcarboxylates, alkylsulfonates, alkylbenzenesulfonates, alkylnapthylenesulfonates, alkylsulfate esters, alkylphosphate esters, N-acyl-N-alkyltaurines, sulfosuccinate esters, sulfoalkylpolyoxyethylenealkylphenyl ethers and polyoxyethylenealkylphosphate esters; amphoteric surfactants such as amino acids, aminoalkyl sulfonic acid esters, aminoalkyl sulfate or phosphate esters, alkylbetaines and amine oxides; and cationic surfactants such as alkylamine salts, aliphatic or aromatic quaternary ammonium salts, heterocyclic quaternary ammonium salts of pyridinium, imidazolium or the like and aliphatic or hetero ring-containing phosphonium or sulfonium salts.

In order to prevent static, it is preferable to use a fluorine-containing surfactant as described, for example, in JP-A-60-80849.

The photographic emulsion layers and other hydrophilic colloid layers of the photographic materials of this invention can contain matting agents such as silica, magnesium oxide and polymethyl methacrylate for the purpose of preventing adhesion.

The photosensitive materials used in this invention can contain dispersions of water-insoluble or sparingly soluble synthetic polymers for the purpose of dimensional stability. For example, it is possible to use, either singly or in combination, alkyl (meth)acrylate, alkoxylakyl (meth)acrylate, glycidyl (meth)acrylate and the like or polymers which have these and acrylic acid, methacrylic acid or other such combinations as their monomer components.

It is advantageous to use gelatin as the binder or protective colloid for the photographic emulsion, but it is possible to use other hydrophilic colloids. For example, it is possible to use gelatin derivatives, graft polymers of gelatin and other macromolecules, albumin, casein and other such proteins; hydroxyethyl cellulose, carboxymethyl cellulose, cellulose sulfate esters and other such cellulose derivatives; sodium alginate; starch derivatives and other such sugar derivatives; and polyvinyl alcohol, polyvinyl alcohol part acetal, poly-N-vinyl pyrrolidone, polyacrylic acid, polymethacrylic acid, polyacrylamide, polyvinyl imidazole, polyvinyl pyrazole, copolymers of such monomers or other such synthetic hydrophilic macromolecular substances.

In addition to lime-treated gelatin, acid-treated gelatin may also be used as the gelatin and it is also possible to use gelatin hydrolysis products and gelatin enzymolysis products.

In this invention, a particularly preferred gelatin is the gelatin containing 12% by weight or more, preferably 14% by weight or more, of a high molecular weight component as disclosed in JP-A-62-237444.

The proportion of the gelatin occupied by the high molecular weight component is measured in this invention by the gel permeation chromatograph method (referred to as the "GPC method" hereinbelow).

The conditions for the GPC method are now given.

a. Column: GS-620 (made by the Asahi Kasei Kogyo Kabushiki Kaisha),
   Length 500 mm, temperature 37° C.,
   Diameter 7.6 mm×3
b. Fractionating solution: 0.05 M $Na_2HPO_4$-$KH_2PO_4$ Aqueous solution,
   Flow rate:ml/min
c. Detector: ultraviolet absorbing spectrophotometer (UV: wavelength 254 nm)
d. Analysis sample: gelatin with an absolute weight of 0.4 μg On the GPC curve obtained with the retention time on the abscissa and the absorbance on the ordinate, first of all an exclusion limit peak appears and then peaks thought to be the β constituent and α constituent of the gelatin appear, after which it assumes a form in which there is a tailing off as the retention time is lengthened. The proportion occupied by the high molecular weight component in this invention can be determined by calculating the proportion of the whole of the surface area occupied by the surface area of the exclusion limit peak. Specifically, a perpendicular line is drawn onto the abscissa from the minimum point on the GPC graph appearing at the position for a retention time of about 25 minutes and the proportion of the surface area of the portion to the left of this line (high molecular weight component) in the surface area of the whole is calculated.

As described in JP-A-62-87952 and JP-A-62-237444, gelatin films rich in high molecular weight components provide a strong wet film strength and are able to prevent degradation in the washing solution by reducing elution into the solution.

By way of supports for the photographic materials of this invention, it is possible to use cellulose triacetate, cellulose diacetate, nitrocellulose, polystyrene, polyethylene terephthalate paper, baryta coated paper, polyolefin covered paper and the like.

It is preferable that the developing agents used in the developing solutions employed in this invention contain dihydroxybenzenes, and there will be cases of the use of a combination of dihydroxybenzenes and 1-phenyl-3-pyrazolidones, or of a combination of dihydroxybenzenes and p-aminophenols.

By way of dihydroxybenzene developing agents used in this invention, there are hydroquinone, chlorohydroquinone, bromohydroquinone, isopropylhydroquinone, methylhydroquinone,2,3-dichlorohydroquinone,2,5-dichlorohydroquinone, 2,3-dibromohydroquinone and 2,5-dimethylhydroquinone and the like, but hydroquinone is particularly preferred.

By way of developing agents which are 1-phenyl-3-pyrazolidone or derivatives thereof and are used in this invention, there are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone and the like.

By way of p-aminophenol-based developing agents used in this invention, there are N-methyl-p-aminophenol, p-aminophenol, N-(β-hydroxyethyl)-p-aminophenol, N-(4-hydroxyphenyl)glycine, 2-methyl-p-aminophenol-p-benzylaminophenol and the like, and of these N-methyl-p-aminophenol is preferred.

Normally, it is preferable to use the developing agent in an amount of 0.05 mol/l–0.8 mol/l. Further, when using a combination of dihydroxybenzenes and 1-phenyl-3-pyrazolidones or p-aminophenols, it is preferable to use the former in an amount of 0.05 mol/l–0.5 mol/l and the latter in an amount of 0.06 mol/l or less.

By way of sulfite preservatives used in this invention, there are, for example, sodium sulfite, potassium sulfite, lithium sulfite, ammonium sulfite, sodium bisulfite, potassium metabisulfite and sodium formaldehyde bisulfite. 0.15 Mol/l or above, and particularly 0.4 mol/l or above, are preferred for the sulfites. Further, it is preferable to adopt an upper limit of up to 2.5 mol/l, particularly up to 1.2 mol/l.

Amongst the alkalies used to set the pH, there are pH adjusters and buffers such as sodium hydroxide, potassium hydroxide, sodium carbonate, potassium carbonate, sodium triphosphate, potassium triphosphate, sodium silicate and potassium silicate.

By way of additives which are used in addition to the abovementioned components, it is possible to include compounds such as boric acid and borax, sodium boride, potassium boride, potassium iodide and other such development inhibitors; ethylene glycol, diethylene glycol, triethylene glycol, dimethylformamide, methylcellosolve, hexylene glycol, ethanol, methanol and other such organic solvents; 5-nitroindazole and other such indazole-based compounds, 5-methylbenzotriazole and other such benzotriazole-based compounds and other such antifoggants, and, moreover, toners, surfactants, defoaming agents, water softeners, film hardeners, development accelerators and the like may be included as required. In particular, the amino compounds described JP-A-56-106244 and the imidazole compounds described in JP-B-48-35493 are preferred from the standpoint of development acceleration or speed enhancement.

By way of buffers, boric acid as described in JP-A-62-186259, saccharides (for example, saccharose) as described in JP-A-60-93433, oximes (for example, acetoxime), phenols (for example, 5-sulfosalicylate), triphosphates (for example, the sodium salt or potassium salt) and the like are used in the developing solutions employed in this invention, and boric acid is used for preference.

The fixing solutions are aqueous solutions which include, in addition to fixers, film hardeners (for example, water-soluble aluminum compounds), acetic acid and dibasic acids (for example, tartaric acid, citric acid or salts thereof) as required, and they preferably have a pH of 3.8 or more, more preferably of 4.0–5.5.

By way of fixers, there are sodium thiosulfate, ammonium thiosulfate and the like, ammonium thiosulfate being particularly preferred from the standpoint of the fixing rate. The amount of fixer used can be altered as appropriate and is generally about 0.1 to about 5 mol/l.

The water-soluble aluminum salts which function mainly as film hardeners in the fixing solution are generally compounds known as film hardeners for acidic film-hardening fixing solutions, examples including aluminum chloride, aluminum sulfate and potash alum.

By way of the dibasic acids mentioned above, it is possible to use, either singly or two or more of, tartaric acid or derivatives thereof and citric acid or derivatives thereof. These compounds are effective if contained at 0.005 mole or above per liter of fixing solution, and particularly effective at 0.01 mol/l 0.03 mol/l.

Specifically, there are tartaric acid, potassium tartrate, sodium tartrate, potassium sodium tartrate, ammonium tartrate, potassium ammonium tartrate and the like.

As examples of the citric acid or derivatives thereof which are effective in this invention, there are citric acid, sodium citrate, potassium citrate and the like.

If desired, the fixing solution can further contain preservatives (for example, sulfites, bisulfites), pH buffers (for example, acetic acid, boric acid), pH adjusters (for example, ammonia, sulfuric acid), image storage improvers (for example, potassium iodide) and chelating agents. Here, the pH buffers are used in a range of 10–40 g/l, and preferably 18–25 g/l, owing to the high pH of the developing solution.

The fixing temperatures and times are the same as for the development, preferably about 20° C.–about 50° C. and 10 sec.–1 min.

According to the above method, the developed and fixed photographic materials are washed and dried. Washing is carried out to remove almost all of the silver salts dissolved by fixing and is preferably carried out at about 20° C.–about 50° C. for 10 sec.–3 min. Drying is carried out at about 40° C.–about 100° C. and the drying time can be altered appropriately in accordance with the surrounding conditions, but it is normally about 5 sec.–3 min. 30 sec.

Roller conveyor automatic developing apparatuses are described, for example, in U.S. Pat. Nos. 3,025,779 and 3,545,971, and in the present specification reference will simply be made to a roller conveyor processor. Roller conveyor processors comprise the four stages development, fixing, washing and drying and, although other stages (for example, a stopping stage) are not ruled out, it is most preferable to follow these four stages in this invention as well. In this invention, the photographic material can be developed within the development time of 15 seconds and dried within 60 seconds using such automatic developing apparatuses. Thus, quick processings can be effected according to this invention. It is also possible to economize upon water in the washing stage by the use of a 2 or 3 stage countercurrent washing system. The replenishment amount in the washing and/or stabilizing processes which follow the development processing of this invention is 1,200 ml/m$^2$ or less and preferably 800 ml/m$^2$ or less including cases in which the replenishment amount is zero. The multistage countercurrent system (for example, with 2 stages or 3 stages) has long been known as a method for reducing the replenishment amount.

It is possible to obtain, a good processing performance by a combination of the following techniques against the problems which occur when the washing water replenishment amount has been reduced.

In the washing bath or stabilization bath, it is possible to make conjoint use of the isothiazoline-based compounds described in *Image Tech.*, 10, (6) 242 (1984) by R.T. Kreiman, the isothiazoline-based compounds described in *Research Disclosure* (RD), Vol. 205, No. 20526 (May 1981) and the isothiazoline-based compounds described in *Research Disclosure* Vol. 228, No. 22845, JP-A-61-115154 and JP-A-62-209532 as microbiocides.

In addition, it is possible to include compounds such as those described in *Bokin Bobai no Kagaku* (The Chemistry of Microbial and Fungal Prevention) by H. Horiguchi, Sankyo Publishing (1982), *Bokin Bobai Gijutsu Handobukku* (Antibacterial Antifungal Technology Handbook) by the Nippon Bokin Bobai Gakkai (Japanese Antibacterial, Antifungal Society) Hakuhodo (1986), *Water Quality Criteria Photo Sci. & Eng.*, Vol. 9, No. 6, (1965) by L.E. West, "Microbiological Growths in Motion-Picture Processing" by M.W. Beach in *SMPTE* Journal Vol. 85. (1976) and "Photo Processing Wash Water Biocides" by R.O. Deegan in *J. Imacinc Tech.*, Vol. 10, No. 6, (1984).

When washing with a small amount of washing water in the method of this invention, it is preferable to provide a squeeze roller and crossover rack cleaning tank as described, for example, in Japanese Patent Application No. 61-163217 and Japanese Patent Application No. 611313.

Further, part or all of the overflow from the washing or stabilizing bath, which is produced by replenishment of water which has undergone a microbiocidal procedure in the washing or stabilizing bath of this invention, in accordance with the processing, can be employed in a processing solution having a fixing capability, which is the processing stage prior to these, as described in JP-A-60-235133 and JP-A-63-129343.

Further, water-soluble surfactants and defoaming agents may be added to prevent water-bubble collections which readily occur when washing with small amounts of washing water.

In addition, the dye adsorbers disclosed in JP-A-63-163456 may be distributed in the washing tank in order to prevent staining caused by dyes eluted from the photographic material.

The invention is explained in detail below with reference to examples.

EXAMPLE 1

Emulsions A–E were prepared using the following methods.

(Emulsion A)

An aqueous silver nitrate solution and an aqueous solution of sodium bromide and sodium chloride containing $3\times10^{-7}$ mole of $K_3IrCl_6$ and $3\times10^{-7}$ mole of $(NH_4)_3RhCl_6$ per mole of silver were simultaneously added over 30 minutes to an aqueous gelatin solution maintained at 58° C., and the potential was maintained at 150 mV over this period to prepare a monodisperse silver chlorobromide emulsion with an average grain size of 0.28 $\mu$. Conversion was carried out by adding, per mole of silver, 0.2 mol% of a 1% aqueous potassium iodide solution to this emulsion and desalting was carried out by a flocculation method. Hypo and chloroauric acid were added to this emulsion and chemical ripening carried out while maintaining at 60° C., and then a 1% solution of 4-hydroxy-6-methyl-1,3,3a,7-tetraazaindene was added at 30 ml per mole of silver as a stabilizer.

(Emulsion B)

A monodisperse silver chloroiodobromide emulsion with an average grain size of 0.10 $\mu$ was prepared with exactly the same method as that for Emulsion A in an aqueous gelatin solution maintained at 40° C.

(Emulsion C)

An aqueous silver nitrate solution and an aqueous solution of sodium chloride containing $3\times10^{-7}$ mole of $K_3IrCl_6$ and $3\times10^{-7}$ mole of $(NH_4)_3RhCl_6$ per mole of silver were simultaneously added over 30 minutes to an aqueous gelatin solution maintained at 35° C., and the potential was maintained at 150 mV over this period. Following this, conversion was carried out by adding, per mole of silver, 2 mol% of a 1% aqueous potassium bromide solution and 0.2 mol% of an aqueous potassium iodide solution. Hypo and chloroauric acid were added to this emulsion and chemical ripening carried out while maintaining at 60° C. and then a stabilizer was added in the same way as with Emulsion A.

(Emulsion D)

An aqueous silver nitrate solution, an aqueous solution of sodium chloride containing $3\times10^{-7}$ mole of $K_3IrCl_6$ $3\times10^{-7}$ mole of $(NH_4)_3RhCl_6$ per mole of silver and sodium bromide equivalent to 20 mol% per mole of silver were simultaneously added over 30 minutes to an aqueous gelatin solution maintained at 48° C., the potential was maintained at 70 mV over this period, thereby producing a monodisperse silver chlorobromide emulsion with an average grain size of 0.28 μ. Conversion was carried out by adding, per mole of silver, 0.2 mol% of a 1% aqueous potassium iodide solution to this emulsion and then carrying out desilvering by a flocculation method. Hypo and chloroauric acid were added to this emulsion and chemical ripening carried out while maintaining at 60° C. and then a stabilizer was added in the same way as with Emulsion A.

(Emulsion E)

A silver chloroiodobromide emulsion with a silver bromide content of 30 mol% was prepared by the same method as Emulsion D in an aqueous gelatin solution maintained at 40° C.

The properties of Emulsions A–E are summarized in Table 1.

TABLE 1

| Emulsion | Halogen composition*1 | Dispersion coefficient | Grain size | Crystal habit |
|---|---|---|---|---|
| A | $AgCl_{97.8}Br_2I_{0.2}$ | 8% | 0.29μ | Cubic |
| B | $AgCl_{94.8}Br_5I_{0.2}$ | 10% | 0:10μ | " |
| C | $AgCl_{97.8}Br_2I_{0.2}$ | 9% | 0.10μ | " |
| D*2 | $AgCl_{79.8}Br_{20}I_{0.2}$ | 10% | 0.24μ | " |
| E*2 | $AgCl_{69.8}Br_{30}I_{0.1}$ | 12% | 0.10μ | " |

(Note)
*1 $AgCl_x Br_y I_z$(x,y,z: mol % per mol of Ag)
*2 comparative sample

Sensitization in the infrared region was carried out by adding 60 ml of a 0.05 wt% solution of the infrared-sensitizing dye II- 6 to 1 kg of these emulsions (Ag 104.5 g, gelatin 51 g). 70 ml of a 0.5% methanol solution of disodium 4,4'-bis-(4,6-dinaphthoxypyrimidin-2-ylamino)stilbene disulfonate and 90 ml of a 0.5% methanol solution, of 2,5-dimethyl-3-allylbenzothiazole iodide were added to the emulsion for supersensitization and stabilization. Further, 100 mg/m² of hydroquinone, a 25 wt%, based on gelatin binder, of polyethyl acrylate latex as a plasticizer and 2-bis(vinylsulfonylacetamido)ethane as a film hardener (the amount shown in Table 2) were added, and coating was carried out on a polyester support to a silver amount of 3.7 g/m². There were 2.5 g/m² of gelatin.

Samples 1–20 were prepared by simultaneously coating, on the top of this, an upper protective layer which contained 0.6 g/m² of gelatin, 60 mg/m² of polymethyl methacrylate with a particle size of 3–4 μ as a matting agent, 70 mg/m² of colloidal silica with a grain size of 10–20 μm and 100 mg/m² of silicone oil, and, as auxiliary coating agents, sodium dodecylbenzenesulfonate and the fluorine-based surfactant with the structural formula (1) given below, and a lower protective layer which contained 0.7 g/m² of gelatin, 225 mg/m² of polyethyl acrylate latex, 20 mg/m² of the dye (2) and 10 mg/m² of the dye (3) with the structural formulae given above and, as an auxiliary coating agent, sodium dodecylbenzenesulfonate.

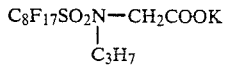

(1)

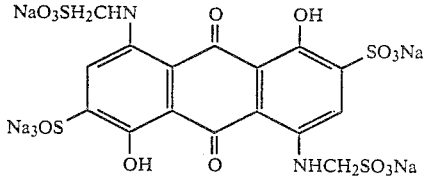

(2)

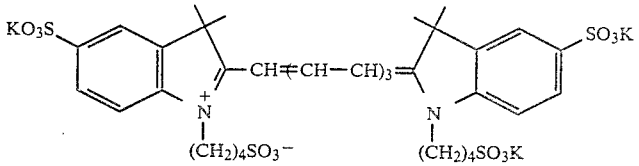

(3)

Moreover, the base used in this example had a backing layer and a backing protective layer with the following compositions. (The swelling rate of the backing layer was 110%.)

| (Backing layer) | |
|---|---|
| Gelatin | 3.0 g/m² |
| Sodium dodecylbenzenesulfonate | 80 mg/m² |
| Dye a | 80 mg/m² |
| Dye b | 30 mg/m² |
| Dye c | 100 mg |
| 1,3-Divinylsulfonyl-2-propanol | 60 mg/m² |
| Potassium polyvinylbenzenesulfonate | 30 g/m² |

Dye a

-continued

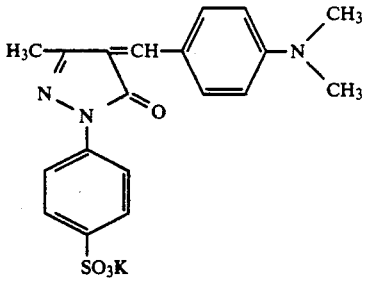

Dye b

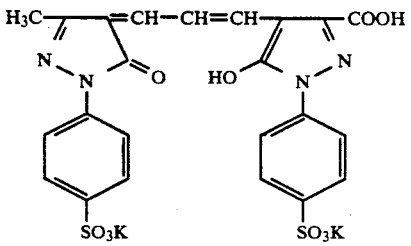

Dye c

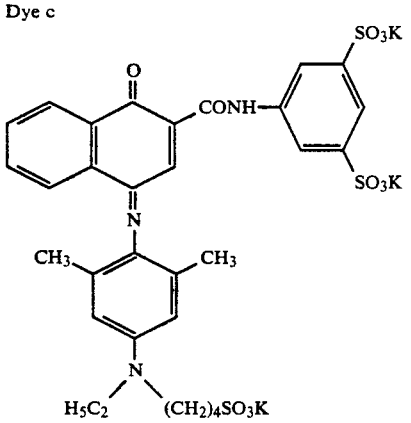

| (Backing protective layer) | |
|---|---|
| Gelatin | 0.75 g/m$^2$ |
| Polymethyl methacrylate (particle size 4.7μ) | 30 mg/m$^2$ |
| Sodium dodecylbenzenesulfonate | 20 mg/m$^2$ |
| Fluorine-based surfactant (the above-mentioned compound (1) | 2 mg/m$^2$ |
| Silicone oil | 100 mg/m$^2$ |

Assessment of photographic performance

The samples obtained were exposed via a continuous wedge and an interference filter with a peak at 780 nm using a xenon flashlight with an emission time of $10^{-6}$ sec. and then, using the developing solutions and fixing solutions with the following compositions and the automatic developing apparatus FG-360F made by the Fuji Photo Film Co., Ltd. (washing tank capacity 6 liter), developed for 20 seconds at 38° C., fixed, washed and dried and subjected to sensitometric analysis. (Photographic performance 1)

For an evaluation of the running suitability, the quatered materials (size: 25.4 cm×30.5 cm) were exposed to light to an extent that the ratio of exposed area to the entire area was 50 %, and 100 exposed films were continuously processed in the developing solution and fixing solution without replenishment and then processed by the same method as mentioned above. (Photographic performance 2).

In the assessment, the reciprocal of an exposure providing a density of 3.0 was determined for photographic performances 1 and 2 and the difference between them (D log E) is shown in Table 2.

Gamma is the gradient of the straight line connecting the points for densities of 0.3 and 3.0 on the characteristic curve, and this was determined for photographic performances 1 and 2 and the difference (D gamma) is shown in Table 2. A larger value denotes a greater liability to changes in the photographic performance due to running.

In the assessment of suitability to water-saving processing, a comparison was made between 100 quatered films processed with 60 ml/(quartered film) replenishment (785 ml/m$^2$) and with normal running water washing (4,000 ml/m$^2$), wherein in the former water saving processing, 0.8 g/l of EDTA.2Na.2$H_2O$ was included in the washing water.

An assessment of the roller staining in the dry zone was made in 5 stages: "5" denoting absolutely no roller staining, "1" denoting its occurrence over the entire roller surface. "3" or less being unsuitable for practical purposes.

| (Developing solution) | |
|---|---|
| Hydroquinone | 45.0 g |
| N-methyl-p-aminophenol · ½ sulfate | 0.8 g |
| Sodium hydroxide | 18.0 g |
| Potassium hydroxide | 55.0 g |
| 5-Sulfosalycylic acid | 45.0 g |
| Boric acid | 25.0 g |
| Potassium sulfite | 110.0 g |
| Disodium ethylenediaminetetraacetate | 1.0 g |
| 2-Mercaptobenzimidazole-5-sulfonic acid | 0.3 g |
| Potassium bromide | 6.0 g |
| 5-Methylbenzotriazole | 0.6 g |
| n-Butyldiethanolamine | 15.0 g |
| Water to make | 1 liter |
| | (pH = 11.6) |
| (Fixing solution) | |
| Water | 500 ml |
| Ammonium thiosulfate | 200.0 g |
| Sodium sulfite (anhydrous) | 20.0 g |
| Disodium ethylenediaminetetraacetate | 0.1 g |
| Tartaric acid | 2.0 g |
| Sodium hydroxide | 0.25 g |
| Glacial acetic acid | 18 g |
| Water to make | 1 liter |

TABLE 2

| Sample No. | Emulsion used | Amount of hardener added mmol/100 g Gel | Swelling rate | Running stability D log E | D gamma | Dryzone roller staining Water-saving wash | Running water wash |
|---|---|---|---|---|---|---|---|
| 1 | A | 19.5 | 90 | 0.04 | 0.9 | 5 | 5 |
| 2 | " | 17.5 | 100 | 0.03 | 0.7 | 5 | 5 |
| 3 | " | 14.5 | 120 | 0.03 | 0.6 | 4 | 5 |
| 4* | " | 10.5 | 160 | 0.01 | 0.6 | 2 | 5 |
| 5 | B | 19.5 | 90 | 0.03 | 0.8 | 5 | 5 |
| 6 | " | 17.5 | 100 | 0.02 | 0.6 | 5 | 5 |
| 7 | " | 14.5 | 120 | 0.01 | 0.6 | 4 | 5 |

TABLE 2-continued

| Sample No. | Emulsion used | Amount of hardener added mmol/100 g Gel | Swelling rate | Running stability D log E | D gamma | Dryzone roller staining Water-saving wash | Running water wash |
|---|---|---|---|---|---|---|---|
| 8* | " | 10.5 | 160 | 0.01 | 0.5 | 2 | 5 |
| 9 | C | 19.5 | 90 | 0.03 | 0.8 | 5 | 5 |
| 10 | " | 17.5 | 100 | 0.03 | 0.7 | 5 | 5 |
| 11 | " | 14.5 | 120 | 0.02 | 0.7 | 4 | 5 |
| 12* | " | 10.5 | 160 | 0.01 | 0.5 | 2 | 5 |
| 13* | D | 17.5 | 100 | 0.07 | 1.8 | 5 | 5 |
| 14* | " | 14.5 | 120 | 0.07 | 1.6 | 4 | 5 |
| 15* | " | 10.5 | 160 | 0.05 | 1.5 | 2 | 5 |
| 16* | " | 9.5 | 180 | 0.06 | 1.2 | 1 | 4 |
| 17* | E | 17.5 | 100 | 0.07 | 1.6 | 5 | 5 |
| 18* | " | 14.5 | 120 | 0.06 | 1.4 | 4 | 5 |
| 19* | " | 10.5 | 160 | 0.06 | 1.4 | 2 | 5 |
| 20* | " | 9.5 | 180 | 0.04 | 1.2 | 1 | 4 |

*comparative sample

As is clear from Table 2, the running stability is good and the water-saving washing roller staining is also good with the samples 1–3, 5–7 and 9–11 of this invention.

EXAMPLE 2

Lime-treated gelatin was produced by a method described in the abovementioned JP-A-62-237444 and JP-A-87952. In this case, gelatins A–D containing high molecular weight components as shown in Table 3 were prepared by using the liquid gelatin extract from the final stage of extraction in the extraction operation and combining an operation in which the liquid gelatin extract from the initial extraction is removed and an operation in which the treatment temperature is maintained at less than 40° C. in the production stage until the drying which follows extraction.

(Emulsions F–I)

An aqueous sodium nitrate solution and an aqueous solution of sodium bromide and sodium chloride containing $3\times10^{-7}$ mole of $K_3IrCl_6$ and $3\times10^{-7}$ mole of $(NH_4)_3RhCl_6$ per mole of silver were simultaneously added over 30 minutes to an aqueous gelatin solution maintained at 40° C., and the potential was maintained at 200 mV over this period, thereby preparing a monodisperse silver chlorobromide emulsion with an average grain size of 0.09 μ. Conversion was carried out by adding, per mole of silver, 0.2 mol% of an aqueous potassium iodide solution to this emulsion and then desalting was carried out by a flocculation method, and emulsions F–I were respectively produced using the abovementioned gelatins A–D as the dispersing gelatin. Hypo and chloroauric acid were added to these emulsions and the chemical ripening carried out while maintaining at 60° C. and then, with respect to one mole of silver, 30 ml of a 1% solution of 4-hydroxy-6-methyl-1,3,3a,7-tetraazaindene was added as a stabilizer. ($AgCl_{97.8}Br_2I_{0.2}$; variation coefficient 10%).

Thereafter, the same procedure as in Example 1 was repeated using Emulsion F–I to prepare Samples 21–36 which were subjected to the same processings as in Example 1 except using the developing solution and the fixing solution having the following compositions.

| | |
|---|---|
| (Developing solution) | |
| Hydroquinone | 25.0 g |
| 4-Methyl-4-hydroxymethyl-1-phenyl-3-pyrazolidone | 0.5 g |
| Potassium sulfite | 90.0 g |
| Disodium ethylenediaminetetraacetate | 2.0 g |
| Potassium bromide | 5.0 g |
| 5-Methylbenzotriazole | 0.2 g |
| 2-Mercaptobenzimidazole-5-sulfonic acid | 0.3 g |
| Sodium carbonate (Adjusted to pH 10.6 by the addition of sodium hydroxide) | 20 g |
| Water to make | 1 liter |
| (Fixing solution) | |
| Ammonium thiosulfate | 210 g |
| Sodium sulfite (anhydrous) | 20 g |
| Disodium ethylenediaminetetraacetate | 0.1 g |
| Glacial acetic acid | 15 g |
| Water to make (pH set at 4.8 with ammonia water) | 1 liter |

The assessment of the performances was carried out in the same way as Example 1 and is shown in Table 3.

TABLE 3

| Sample No. | Emulsion used | Gelatin used: Emulsion dispersion | Surface protective layer | Bis(vinylsulfonylmethyl) ether: High molecular weight component | Amount added mmol/100 g Gel | Swelling rate | Dry zone roller staining: Water-saving wash | Running water wash |
|---|---|---|---|---|---|---|---|---|
| 21 | F | A | A | 4.2 wt. % | 18.5 | 90 | 5 | 5 |
| 22 | " | " | " | " | 15.0 | 130 | 4 | 5 |
| 23 | " | " | " | " | 14.0 | 150 | 3.5 | 5 |
| 24* | " | " | " | " | 12.0 | 170 | 2 | 4 |
| 25 | G | B | B | 7.3 wt. % | 18.0 | 90 | 5 | 5 |
| 26 | " | " | " | " | 15.5 | 130 | 4 | 5 |
| 27 | " | " | " | " | 13.5 | 150 | 4 | 5 |
| 28* | " | " | " | " | 11.5 | 170 | 2.5 | 4 |
| 29 | H | C | C | 13.5 wt. % | 18.0 | 90 | 5 | 5 |
| 30 | " | " | " | " | 15.5 | 125 | 5 | 5 |
| 31 | " | " | " | " | 13.5 | 140 | 5 | 5 |
| 32* | " | " | " | " | 11.5 | 165 | 3 | 5 |
| 33 | I | D | D | 15.7 wt. % | 17.5 | 90 | 5 | 5 |

TABLE 3-continued

| Sample No. | Emulsion used | Gelatin used: Emulsion dispersion | Gelatin used: Surface protective layer | Bis(vinylsulfonylmethyl) ether: High molecular weight component | Bis(vinylsulfonylmethyl) ether: Amount added mmol/100 g Gel | Swelling rate | Dry zone roller staining: Water-saving wash | Dry zone roller staining: Running water wash |
|---|---|---|---|---|---|---|---|---|
| 34 | " | " | " | " | 15.0 | 130 | 5 | 5 |
| 35 | " | " | " | " | 13.0 | 150 | 4.5 | 5 |
| 36* | " | " | " | " | 11.0 | 170 | 3 | 5 |

*comparative sample

As is clear from Table 3, roller contamination is very good during water-saving processing even in regions with a comparatively high swelling rate when gelatin rich in high molecular weight components is used.

EXAMPLE 3

Processing was carried out on the photosensitive materials of samples No. 33 and 36 in Example 2 using 120 quatered films with no replenishment for the water washing. However, the washing water contained 1.0 g/l of EDTA·2Na·2$H_2O$ as a microbiocide. A tendency toward dry zone roller contamination and of stain transfer onto the photosensitive material was observed with the photosensitive material No. 36 (comparative sample), there was no roller contamination and good processing performance was obtained with the photosensitive material No. 33 (this invention).

While the invention has been described in detail and with reference to specific embodiments thereof, it will be apparent to one skilled in the art that various changes and modifications can be made therein without departing from the spirit and scope thereof.

What is claimed is:

1. A process for developing a silver halide photographic material having, on a support, at least one silver halide emulsion layer comprising a silver halide emulsion spectrally sensitized by an infrared-sensitizing dye, which is subjected to image-wise exposure, then development and fixing processing and then washing or stabilization processing, wherein the silver halide in the silver halide emulsion layer contains 90 mol% or more of silver chloride, the swelling rate for hydrophilic colloid layers containing the silver halide emulsion layer is 150% or less, and the replenishment in the washing or stabilization processing is 1,200 ml or less per square meter of the photographic material.

2. A process as in claim 1, wherein the binder for the silver halide emulsion layer and other hydrophilic colloid layers is gelatin containing 12% by weight or more of a high molecular weight component.

3. A process as in claim 1, wherein the silver halide comprises monodispersed grains with a variation coefficient of 20% or less.

4. A process as in claim 1, wherein the silver chloride-containing silver halide is selected from the group consisting of silver chlorobromide, silver chloroiodide and silver chloroiodobromide.

5. A process as in claim 4, wherein the silver chloride content is 95 mol% or more.

6. A process as in claim 4, wherein the silver halide has the silver bromide content of 0–10 mol%.

7. A process as in claim 4, wherein the silver halide has the silver iodide content of 0–2 mol%.

8. A process as in claim 3, wherein the variation coeffecient of the monodispersed grains is 15% or less.

9. A process as in claim 1, wherein the grain size of the silver halide is from 0.06–0.6 μm.

10. A process as in claim 1, wherein the silver halide emulsion is prepared at a silver potential of 100 mV or more.

11. A process as in claim 1, wherein the swelling rate of the hydrophilic colloid layers is from 80%–130%.

* * * * *